US007815830B2

(12) United States Patent
Ohlberg et al.

(10) Patent No.: US 7,815,830 B2
(45) Date of Patent: Oct. 19, 2010

(54) METHOD AND DEVICE FOR EXTRUSION PRESSING OF BENT EXTRUDED PROFILES

(75) Inventors: Joachim Ohlberg, Mühlheim (DE); Markus König, Düsseldorf (DE); James Camp, Bonn (DE); Wilfried Geven, Neuss (DE); Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 959 days.

(21) Appl. No.: 10/570,234

(22) PCT Filed: Aug. 18, 2004

(86) PCT No.: PCT/DE2004/001832

§ 371 (c)(1),
(2), (4) Date: Jan. 4, 2007

(87) PCT Pub. No.: WO2005/023447

PCT Pub. Date: Mar. 17, 2005

(65) Prior Publication Data

US 2007/0170614 A1 Jul. 26, 2007

(30) Foreign Application Priority Data

Sep. 2, 2003 (DE) ..... 103 40 772

(51) Int. Cl.
*B29C 47/00* (2006.01)
*B21C 23/00* (2006.01)
*B21C 23/12* (2006.01)

(52) U.S. Cl. ..... 264/151; 264/209.3; 264/210.2; 264/285; 264/295; 264/339; 72/254; 72/256; 72/257; 425/131.1; 425/308; 425/325; 425/403.1; 425/404

(58) Field of Classification Search ..... None
See application file for complete search history.

(56) References Cited

U.S. PATENT DOCUMENTS

| | | | | |
|---|---|---|---|---|
| 2,422,953 | A * | 6/1947 | Drury et al. | 264/211.12 |
| 3,490,113 | A * | 1/1970 | Bulck et al. | 425/172 |
| 5,199,292 | A * | 4/1993 | Del Fabro et al. | 72/307 |
| 5,305,626 | A * | 4/1994 | Tiekink | 72/257 |
| 5,862,698 | A * | 1/1999 | Yogo | 72/173 |
| 6,190,595 | B1 * | 2/2001 | Thoms et al. | 264/177.16 |
| 6,634,200 | B2 * | 10/2003 | Kleiner et al. | 72/260 |
| 6,843,093 | B2 * | 1/2005 | Lindner et al. | 72/254 |

(Continued)

FOREIGN PATENT DOCUMENTS

| | | |
|---|---|---|
| EP | 0 706 843 | 8/1995 |

(Continued)

*Primary Examiner*—Jeffrey Wollschlager
(74) *Attorney, Agent, or Firm*—Andrew Wilford

(57) ABSTRACT

The invention relates to a method for extruding curved extruded profiles. The extruded profile is formed in a matrix mounted upstream in a counter beam of an extruder system and is subsequently curved or bent due to the effect of external forces and separated, supported and arranged into partial lengths in the extrusion flow by means of a separating robot connected to a higher control mechanism and is discharged to a storage area with the aid of a handling robot. The handling robot is coupled to the separating robot by means of the control mechanism and, like the separating robot, is moved into a starting position in front of the extrusion press.

13 Claims, 3 Drawing Sheets

U.S. PATENT DOCUMENTS

| | | | | |
|---|---|---|---|---|
| 6,862,911 | B2 * | 3/2005 | Birkenstock et al. | 72/254 |
| 6,952,942 | B2 * | 10/2005 | Graefe et al. | 72/256 |
| 7,201,571 | B2 * | 4/2007 | Graefe et al. | 425/325 |
| 2004/0045335 | A1 * | 3/2004 | Lindner et al. | 72/254 |
| 2004/0201126 | A1 | 10/2004 | Jakoby et al. | |

FOREIGN PATENT DOCUMENTS

| | | | |
|---|---|---|---|
| WO | WO03024638 | * | 3/2003 |

* cited by examiner

METHOD AND DEVICE FOR EXTRUSION PRESSING OF BENT EXTRUDED PROFILES

CROSS REFERENCE TO RELATED APPLICATIONS

This application is the US national phase of PCT application PCT/DE2004/001832, filed 18 Aug. 2004, published 17 Mar. 2005 as WO2005/023447, and claiming the priority of German patent application 10340772.3 itself filed 2 Sep. 2003, whose entire disclosures are herewith incorporated by reference.

FIELD OF THE INVENTION

The invention regards a method and a device for extrusion pressing of bent extruded profiles, the extruded profile being shaped in a die positioned in front of an cross beam of an extruding press and being subsequently bent or bent off by external forces acting on it, as well as cut into sections while moving by means of a cutter connected to an overhead controller, carried off on a conveyor and transferred to a storage area with the help of a handling robot.

Regarding the production of rounded extruded profiles required in the most different industrial areas for the most different purposes and primarily composed of aluminum and magnesium alloys, it is known from EP 0706843 B1 that for extrusion pressing of hollow products with large variations in wall thickness a force is applied with a pusher (guide tool) on a profile at such a spacing from the die output end or cross beam that there is an effect on the profile shaped in the extrusion die. The pusher can be a roller, a slide surface generating a transverse force, a ball assembly or a similar tool. The conversion into the bent or curved extruded profile is carried out downstream of the extrusion tool in the region where the material can be plastically deformed.

These extruded profiles are continuously bent to one side according to a given radius or alternatingly are bent in both directions and are then separated into the sections required, e.g. by sawing or flame cutting and moved downstream thereafter. For this purpose a method and device of the initially described kind are known from DE 101 41 328 A1. It provides a raisable and lowerable table provided in the press output area, supporting the extruded profile, and separated into function fields, the front field close to the machine being followed by a rear field that can be temporarily pivoted into a position tilted to the base. The front function field always remains in its position, basically supporting the profile and due to its stationary position is there to support the following extruded profiles, while the rear function field that can be pivoted downward provides for the transfer of the separated profile lengths.

As soon as the required section is cut off, the rear function field is lowered so that this section can glide from the support. Then it can be gripped by a handling robot and transferred to an output roller conveyor. Until the rear function field pivots back up into its supporting position, the following extruded profile is supported only by the front function field. On the one hand, the extruded-profile sections can be thus individualized so that there is enough free space for the continuously following profiles and on the other hand, each following profile can be supported again, or respectively still be supported. Damage to the surface of the extruded profile, however, due to relative movement between the support surface and the supported extruded-profile section cannot be excluded, a fact that is even aggravated by the conversion heat.

OBJECT OF THE INVENTION

Therefore it is the object of the invention to create a method and device as described above with improved operational characteristics.

SUMMARY OF THE INVENTION

Regarding a method, this object is attained according to the invention by coupling the handling robot with the cutter by means of the controller and by moving them into an upstream starting position in front of the extruding press, in which the handling robot is situated in an upstream waiting position immediately downstream of the cutter, then, with the start of the separation procedure, is moved together with and synchronously to the cutter, thereby supporting the extruded profile and following its precalculated extrusion path with the cutter to the downstream separation end position, from which the cutter moves back into its starting position with the extruded profile for resynchronization with the extruded profile, while the handling robot transports the separated section to the storage area, deposits it there and is subsequently moved back to its upstream waiting position. Thus an automated, technically synchronized process can be achieved that guarantees that variously bent extruded profiles cut into lengths are transported after the separation procedure from the separation area to the storage area without any relative movement and therefore without any damages to the profile. This way, both the continuously extruded profile and the extruded-profile sections formed after cutting are carefully supported during the transport, the extruded-profile sections not being gripped or clasped, i.e. are not exposed to any mechanical strain.

One embodiment of the invention therefore provides that the support brought into the extrusion path temporarily holds up the extruded profile when the handling robot is moved to the storage area and subsequently to its upstream starting and waiting position.

The invention proposes that the transferred sections are cooled on their conveying path to the storage area. This is carried out on the conveyor path and allows a cooling down of the extruded-profile sections to any desired temperature, prior to further handling or prior to the placing in storage.

Regarding the apparatus, the object of the invention is solved according to the invention by the fact that a handling robot is provided downstream of the cutter and is effective in a work area extending at least from the cutting end position to a transfer device for supportedly receiving a separated extruded-profile section. In the first phase, the extruded profile moves with the cutter by means of the controller such that synchronized movements are ensured and, after the final cut-through, preferably by a saw blade of the cutter, is supported and transferred to the transfer device that is also synchronized with the movements of the extruded profile, and further transported.

The transfer device can be advantageously designed as a fork with several tines to for an adjustable and easily modified transfer device surface that can be adjusted to the profile or to its curve. Thus, even profiles that are complicated and three-dimensionally bent, can be transported without damage. This is facilitated by the fact that the handling robot is coupled to the cutter by means of the controller and follows the precalculated movements or respectively extrusion paths of the profile in the same way the sawing robot does, without moving relative to the extruded profile.

It contributes to careful conveyance when the carrying surfaces, that is the surfaces of the tines, are provided with a heat-resistant layer, e.g. Kevlar.

For the temporary support during transportation carried out by the handling robot from the extruding press or the work area of the cutter, a raisable and lowerable support, such as rollers, can be advantageously arranged in the extrusion path.

The invention proposes that the transfer device consists of several continuously running belts that are set parallel to one another. This way, gentle transfer and careful transport of the still hot, separated extruded-profile sections lying flat on the belts is guaranteed.

According to one embodiment of the invention, a cooling conveyor is arranged downstream of the transfer device, preferably also consisting of several continuously running belts that are set parallel. Alternatively, an output table or the like can be added, the cooling conveyor or the output table being adjusted to actual needs and variable with respect to shape. The geometry of the cooling section is independent of the proceedings in the region of the cutting and handling robots.

It is preferably proposed that the transfer device and the cooling conveyor are made as modules. This section can be easily expanded in breadth and length. Thereby e.g. a cost-saving output variant for certain profiles can be at any time converted into an expanded variant for a wider profile spectrum.

The cooling conveyor, which could also be designed as a cooling tunnel, advantageously is provided with elements for pumping in a cooling agent. Adequate elements are blowers, air and/or water nozzles or the like, arranged above the cooling conveyor.

According to one embodiment of the invention, the end of the cooling conveyor is provided with a tilting device for standing up the extruded-profile sections, the extruded-profile sections thus being immediately brought into an erect stacking position for the following storage.

The automated process chain for cutting, cooling and storing separated bent extruded-profile sections can be further improved by providing a stacking robot followed by a stacking transfer device downstream of the cooling conveyor. According to one embodiment of the invention, the stacking robot has a gripping arm provided with an image recognition means. The image recognition means ensures that the gripping arm or a different adequate gripping system is before the transfer already in a position adjusted to the curve of the extruded-profile sections.

When preferably the cutter, the handling robot and the stacking robot are mounted overhead the whole work area particularly in front of the extruding press cross beam remains empty and therefore freely accessible and useable.

BRIEF DESCRIPTION OF THE DRAWING

Further features and details of the invention are seen in the claims and the following description of an illustrated embodiment of the invention shown in the drawings. Therein:

SPECIFIC DESCRIPTION

Figure 1:
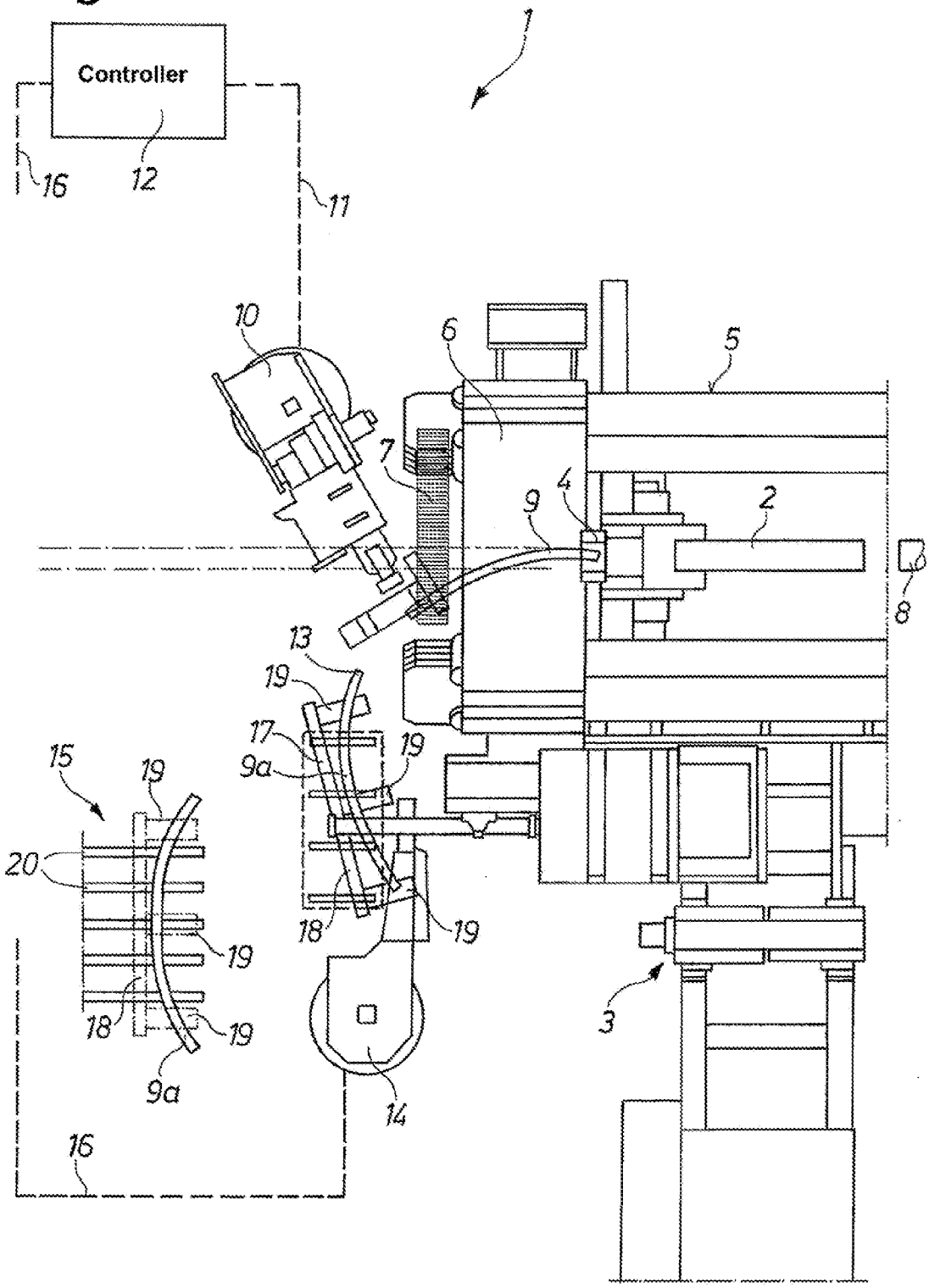
FIG. 1 is a top view of an extruding press for the production of bent extruded profiles with robots provided in the output area.

In an extrusion pressing apparatus as shown in FIG. 1 a billet 2 to be extruded is transported by means of a billet loader 3 upstream of a shaping die or tool 4 of an extruding press 5, of which basically only the cross beam 6 and a guide tool 7 arranged at the output side of the extruding press are illustrated. An extruded profile 9 made by means of an extrusion pusher bar 8 forcing the billet 2 through the die or tool 4 moves downstream from the cross beam 6 and is bent while moving by means of the guide tool 7 into the curve or radius required.

Downstream in the extrusion direction downstream of the guide tool 7 is a cutter 10 that is connected by a control line 11 to an overhead control unit 12, that in the illustrated embodiment is designed as a sawing robot, and that cuts the extruded profile 9 into bent extruded-profile sections 9*a*. The cutter 10 is moved synchronously with the predetermined, precalculated movements of the extruded profile 9 by means of the control unit or controller 12, so as to move downstream together with the extruded profile 9 until the final cut-through is carried out and terminated in the separation end position 13. A handling robot 14 moved here in its waiting position then engages under the separated extruded-profile section 9*a* and transports it to a transfer device 15 for storage. Like the cutter 10, the handling robot 14 is connected to the overhead controller 12 via a control line 16 and consequently is also synchronized with the movements of the extruded string profile 9 or of the extruded-profile section 9*a*.

For a careful transfer and transport of the separated extruded-profile sections 9*a* the handling robot 14 covering the whole work area at least from the transfer device 15 to the separation end position 13 is provided with a transfer device 17 in the form of a fork 18 that in the illustrated embodiment has three tines 19. These tines might be covered with a heat-resistant layer and support the extruded-profile section 9*a* from below without any relative movement to carry the extruded-profile section 9*a* lying down to the transfer device 15 and deposit it there.

Figure 2:
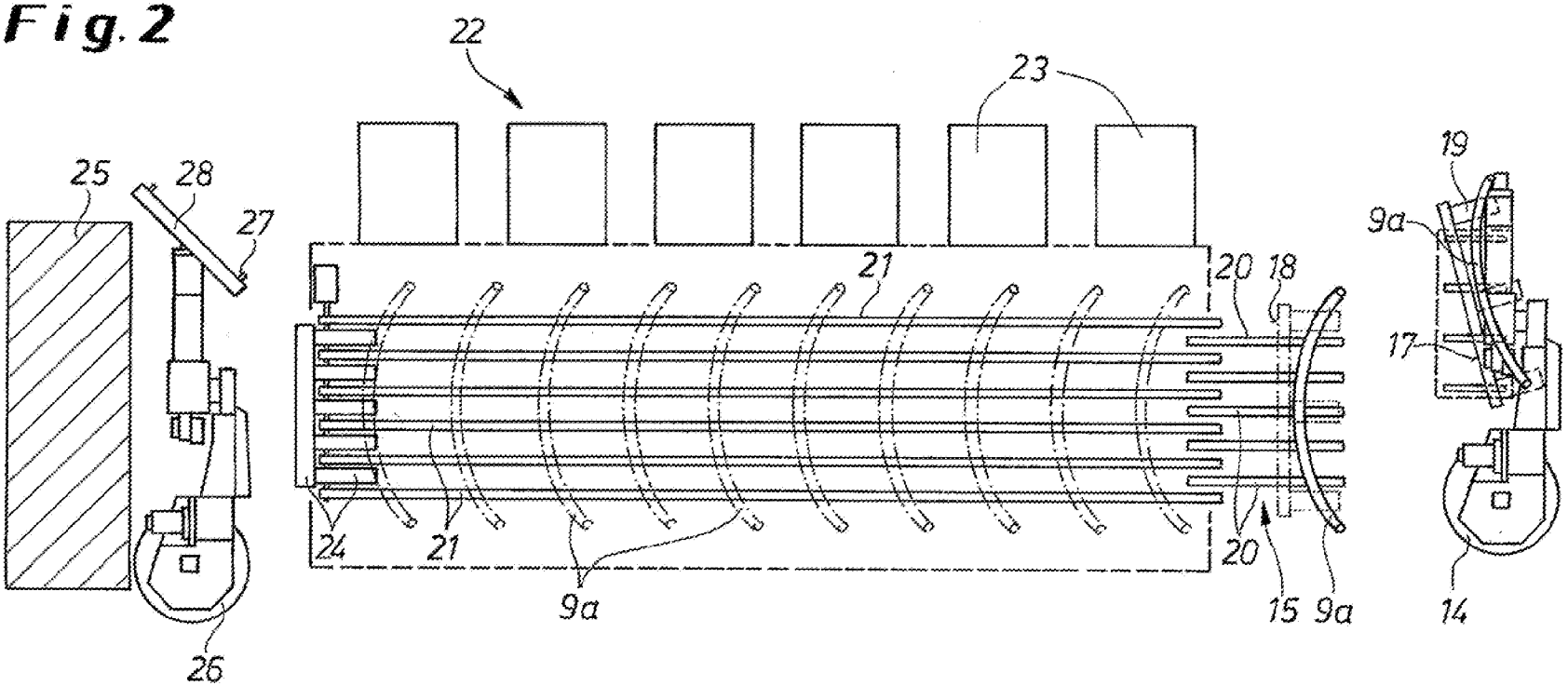
FIG. 2 is a top view of a transfer device as a detail of the output area of the extruding press according to FIG. 1 with a downstream cooling conveyor and an extruded-profile transfer device.

The transfer device 15 here consists of several parallel and continuously running belts 20 leading to a cooling conveyor 22, which also consists of several parallel and continuously running belts 21, and carrying the extruded-profile section 9*a* to the belts 21, as shown in FIG. 2. The cooling conveyor 22 has a row of overhead cooling blower units 23. At the end of the cooling conveyor 22 a tilting device 24 is provided that stands up the extruded-profile sections 9*a* before they are set on a storage shelf 25. For the transfer of the erected extruded-profile sections 9*a* from the tilting device 24 to the storage shelf 25 a stacking robot 26, which has a gripping arm 28 with an image recognition means 27, is provided.

Figure 5:
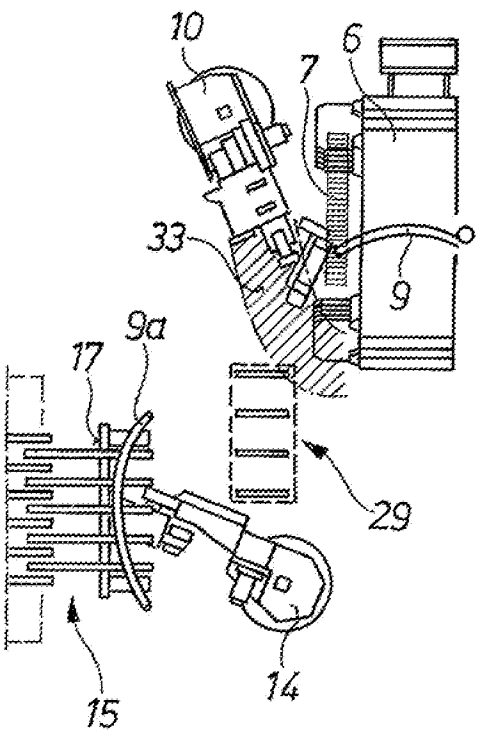
FIG. 5 is a view according to FIGS. 3 and 4 showing a further different position of the robots.
Figure 4:
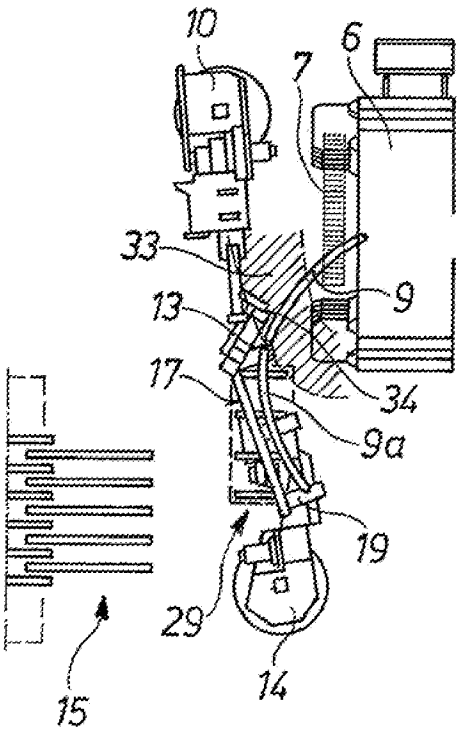
FIG. 4 is a view according to FIG. 3, here showing subsequent positions of the robots.
Figure 3:
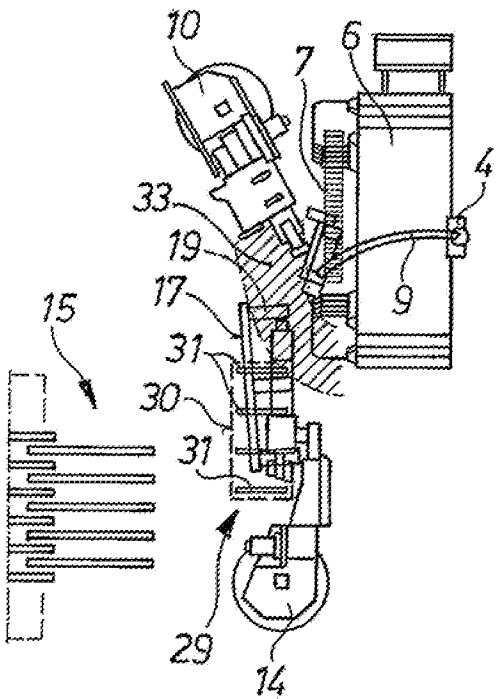
FIG. 3 is the extruding press as a detail of FIG. 1 with the downstream robots moved into their starting positions.

FIGS. 3 to 5 show different operational sequences of the process cycle. With the start of the extrusion pressing of an extruded profile 9 both the cutter 10 and the handling robot 14, which is in a waiting position adjacent the hatched work area 33 of the cutter 10, are in their starting positions. A support 29 in the form of several rollers 32 mounted in a frame 30 following the work area of the cutter 10 is in a lower position not obstructing the path of the handling robot 14 with its transfer device 17. As soon as the extruded profile 9 leaves the cross beam 6 and is bent into a curved shape by the guide tool 7 as required, the cutter 10, which is coupled by means of the controller or control unit 12 (see FIG. 1) such that its movements are synchronized with the movements of the extruded profile 9, moves with the profile or its cut line 34 into the separation end position 13, as shown in FIG. 4.

The extruded profile 9 or the extruded-profile section 9*a* is thus positioned on the transfer device 17 of the handling robot 14 in its waiting position. The handling robot 14 with its transfer device 17 has also been moving synchronously. The handling robot 14 with its transfer device 17 moves from the operating position according to FIG. 4 out of the work area 33 and deposits the extruded-profile section 9*a* in the transfer device 15, as shown in FIG. 5. The cutter 10 has already moved back into its starting position according to FIG. 5 in order to be synchronized with the movement of the continuously extruded profile 9 for the next cut-through.

While the handling robot 14 moves, the support 29 according to FIG. 5 is raised and during this time supports the extruded profile 9 outside the work area 33. It is lowered when the handling robot 14 is moved back and reassumes the support and transfer of the extruded profile 9 or of the extruded-profile section 9*a*. This alternation with automated process cycle for cutting, cooling and storing extruded profiles 9 or extruded-profile sections 9*a* is repeated until the useful mass of the billet 2 to be extruded is used up and restarts with the loading and extrusion of a new billet.

The invention claimed is:

1. A method of making arcuate profile workpieces, the method comprising the steps of:

a) continuously extruding a strand from an output side of a cross beam in a first movement direction;

b) bending the strand by applying a force to it transverse to the direction such that the bent strand moves along an arcuate path diverging from the first movement direction;

c) simultaneously c1) supporting the bent and moving strand at and to between upstream and downstream ends of the arcuate path with a handling robot moving synchronously with the strand along the arcuate path, and c2) engaging a cutter with the supported, bent, and moving strand and cutting through the strand while synchronously moving the cutter along the arcuate path with the supported, bent, and moving strand from the upstream end of the arcuate path to the downstream end of the arcuate path to cut an arcuate profile piece from the strand;

d) after cutting through the strand, returning the cutter to the upstream end of the arcuate path;

e) transferring the arcuate profile piece with the handling robot from the arcuate path to a deposition area and then returning the handling robot to the upstream end of the arcuate path;

f) while the robot is transferring the piece to the deposition area and returning therefrom to the upstream end, raising a vertically shiftable support up into engagement underneath the strand at the upstream end to support the strand and, on return of the robot to the upstream end, lowering the support down away from the strand; and g) repeating the above steps until the strand is exhausted.

2. The method defined in claim 1 wherein the deposition area is an upstream end of a conveyor, the method further comprising the steps between steps e) and f) of:

e1) transporting the arcuate profile piece with the conveyor to a storage area while simultaneously cooling the arcuate profile piece; and e2) taking the arcuate profile piece off the conveyor and stacking the arcuate profile piece in the storage area.

3. The method defined in claim 2 wherein the arcuate profile pieces are transported to the storage area lying on a conveyor in a generally horizontal plane, the method further comprising the step of:

e3) tipping the pieces adjacent the storage area into positions lying in generally vertical planes and stacking them in this position.

4. The method defined in claim 1 wherein the strand or the piece thereof is always supported by the robot from below, the cutter attacking the strand from above.

5. A method of operating an extrusion-pressing apparatus for making arcuate profile workpieces, the apparatus having an extrusion press having a cross beam with an output side, a handling robot, a cutter, and a transfer device, the method comprising the steps of continuously extruding a strand from the output side in a first movement direction;

bending the strand by applying a force to it transverse to the direction such that the bent strand moves along an arcuate path diverging from the first movement direction, supporting the bent and moving strand with the robot at and between upstream and downstream ends of the arcuate path while moving the robot synchronously with the strand along the arcuate path, and engaging the cutter with the supported, bent, and moving strand and cutting through the strand while synchronously moving the cutter with the robot along the arcuate path with the supported, bent, and moving strand and with the robot from the upstream end of the arcuate path to the downstream end of the arcuate path to cut an arcuate profile piece from the strand, and thereafter supporting the strand at the upstream end by engaging a vertically shiftable support up against the strand;

returning the cutter to the upstream end of the arcuate path, releasing the arcuate profile piece from the robot, and transferring the arcuate profile piece with the transfer device from the downstream end of the arcuate path to a deposition area, and returning the robot to the upstream end of the arcuate path to reassume supporting the strand while shifting the support downward out of engagement with the strand.

6. The method defined in claim 5 wherein the transfer device is a fork engageable under the arcuate piece.

7. The method defined in claim 6 wherein the fork has heat-resistant tines.

8. The method defined in claim 5 wherein the deposition area includes a conveyor having a plurality of endless conveyor elements, the method further comprising the step of using the conveyor to move the arcuate profile piece from the deposition area to a storage area.

9. The method defined in claim 8, further comprising the step of cooling the piece while moving it from the deposition area to the storage area.

10. The method defined in claim 9 wherein the conveyor engages the piece from below and has cooling means for projecting a cooling agent on the piece from above.

11. The method defined in claim 9, further comprising the step of:

tipping the piece from a position lying in a generally horizontal plane on the conveyor to a position with the piece lying in an upright plane, and stacking the piece upright in the storage area.

12. The method defined in claim 11 wherein the piece is tipped by means including means for optically scanning the pieces.

13. The method defined in claim 5 wherein the cutter and handling robot are suspended from above the arcuate path.

* * * * *